US005183348A

United States Patent [19]

Kato

[11] Patent Number: 5,183,348

[45] Date of Patent: Feb. 2, 1993

[54] PRINTER HAVING TRACTOR UNIT ATTACHABLE TO ONE OF UPSTREAM AND DOWNSTREAM SIDES OF PLATEN

[75] Inventor: Hiroyuki Kato, Nagoya, Japan

[73] Assignee: Brother Kogyo Kabushiki Kaisha, Aichi, Japan

[21] Appl. No.: 895,107

[22] Filed: Jun. 8, 1992

[30] Foreign Application Priority Data

Jun. 14, 1991 [JP] Japan ..... 3-044904[U]

[51] Int. Cl.[5] ..... B41J 11/26

[52] U.S. Cl. ..... 400/616.2; 226/74

[58] Field of Search ..... 400/616.2, 616.1, 629, 400/635, 605, 618; 226/74, 75, 108, 109, 110

[56] References Cited

U.S. PATENT DOCUMENTS

| | | | |
|---|---|---|---|
| 3,224,366 | 12/1965 | Cummingham | 400/616.2 |
| 4,995,745 | 2/1991 | Yokol et al. | 400/605 |
| 5,037,222 | 8/1991 | Quick et al. | 400/605 |
| 5,123,583 | 6/1992 | Kato et al. | 226/74 |

FOREIGN PATENT DOCUMENTS

| | | | |
|---|---|---|---|
| 0089633 | 9/1983 | European Pat. Off. | 400/616.1 |
| 0118886 | 9/1980 | Japan | 400/616.2 |

OTHER PUBLICATIONS

"Bidirectional Printer Carriage", IBM Technical Disclosure Bulletin, vol. 15, No. 1, Jun. 1972, p. 157.

"Controlled Path for Continuous Form Feeding", IBM Tech. Disclosure Bulletin, vol. 1, No. 6, Apr. 1959, p. 3.

"Independent Dual Form Feed", IBM Technical Disclosure Bulletin, vol. 20, No. 8, Jan. 1978, pp. 3179–3180.

"Forms Carriage Horizontal Vernier", IBM Tech., Disclosure Bulletin, vol. 32, No. 513, Oct. 1989, pp. 250–252.

*Primary Examiner*—Eugene H. Eickholt

*Attorney, Agent, or Firm*—Kane, Dalsimer, Sullivan, Kurucz, Levy, Eisele and Richard

[57] ABSTRACT

To prevent concurrent mounting of two tractor units on an upstream side and a downstream side of a platen of a printer, a rocker member is pivotally mounted by a pivot pin on a side plate of a chassis to which the tractor unit is attachable. The rocker member has an upper end portion disposed close to an upper lock pin of a downstream side mounting portion. The lower end portion of the rocker member is disposed close to a lower lock pin of an upstream side mounting portion. When the tractor unit is locked with the lower lock pin, the lower end portion of the rocker member is firmly locked in position against rotation, so that the upper end portion of the rocker member is no longer separable from the upper rock pin, and hence, is able to prevent another tractor unit from moving into that portion.

11 Claims, 8 Drawing Sheets

PRINTER HAVING TRACTOR UNIT ATTACHABLE TO ONE OF UPSTREAM AND DOWNSTREAM SIDES OF PLATEN

BACKGROUND OF THE INVENTION

The present invention relates to a printer, and more particularly to a structure of a printer so constructed as to permit a tractor as a printing sheet feed means to be attached selectively to an upstream side and a downstream side of a platen as viewed from the direction of feed of the printing sheet.

An arrangement in which two tractor units of an identical construction are disposed on an upstream side and a downstream side of a platen of a printer is known from Japanese Patent Publication (Kokoku) No. 60-36950. This arrangement needs a mechanism for enabling the downstream side tractor unit to be drivable alone. While the upstream side tractor unit is disconnected to a drive source, the downstream side tractor unit is driven to exert a tension on the printing sheet so that a tension is imparted on the printing sheet for operating the upstream side tractor with the tension. To this end, a clutch or the like mechanism is required, which mechanism, however, makes the printer complicated in construction and expensive to manufacture.

There has been provided a certain type of continuous-feed printing sheet such as a multiple-part printing sheet stack in which a plurality of sheets are stacked with one another for simultaneous printing. If printing is to be carried out with respect to such multiple sheet stack at one time, it is necessary to reduce contacting length of the multiple sheet stack with an outer peripheral surface of a platen in order to reduce relative displacement between superposing sheets (to maintain alignment among the multiple sheets), and to prevent the multiple sheet stack from being jamming in the vicinity of a supply opening reaching the platen.

To this end, a tractor unit is disposed on a downstream side of the platen as viewed from the direction of feed of the continuous-feed, multiple-part printing sheet stack. On the other hand, when a continuous-feed printing sheet composed of a single sheet is used, the printing sheet must be partly wound reliably around the platen to accomplish a high-speed printing. To this end, a tractor unit mounting portion is disposed on an upstream side of the platen as viewed from the printing sheet feed direction. This arrangement also has the advantageous of reducing the overall size of a printer.

SUMMARY OF THE INVENTION

The inventor has established an inhouse proposal as to a printer capable of attaching an identical tractor selectively to an upstream side and a downstream side of a platen as viewed from the direction of feed of a printing sheet, depending on a kind of the printing sheet as disclosed in U.S. patent application Ser. No. 07/764,348 filed Sept. 23, 1991.

In the case where a plurality of such printers are owned by a single user, the operator may think up an erroneous use of the printers that two tractor units are mounted on both upstream and downstream sides of one printer by using the tractor unit of another printer. However, since the printer is so constructed as to receive only one selectively attachable tractor, even if two tractor units are attached to the upstream side and the downstream side of the platen, the two tractor units feed the printing sheet at the same speed and it is not possible to drive only one of the two tractor units. Accordingly, once the printing sheet is engaged with tractor pins of the tractor units under an insufficiently tensioned condition, it is no longer possible to exert a tension on the printing sheet thereafter. The printing sheet is, therefore, liable to become wavy or floating, resulting in jamming of the printing sheet or overloading of a motor which drives the tractor unit.

With the foregoing problems in view, an object of the present invention is to provide a printer which is able to prevent an erroneous concurrent attachment of two tractor units to upstream and downstream sides of a platen of the printer.

This and other objects of the invention will be attained by providing a printer for printing an image on a printing sheet comprising a chassis, a platen, a tractor unit and means for preventing another identical tractor unit of another printer from being attached on the chassis. The platen is rotatably supported by the chassis for supporting and feeding the printing sheet in a sheet feeding direction, the platen defining a printing section. The tractor unit is adapted for feeding the printing sheet to the printing section. The chassis provides a first tractor unit attaching portion positioned downstream of the platen with respect to the sheet feeding direction and a second tractor unit attaching portion positioned upstream of the platen. The tractor unit is selectively mounted on one of the first and second tractor unit attaching portions. Is provided the means for preventing another identical tractor unit of another printer from being attached onto one of the first and second tractor unit attaching portions if remaining one of the second and first tractor unit attaching portion has already accommodated therein the tractor unit.

DETAILED DESCRIPTION OF THE PREFERRED EMBODIMENTS

A printer according to a first embodiment of the present invention will be described with reference to FIGS. 1 through 7. Throughout the specification, the expressions "front", "rear", "above", "below" "laterally", "right" and "left" are used herein to define the various parts when the printer is disposed in an orientation in which it is intended to be used.

Figure 1:
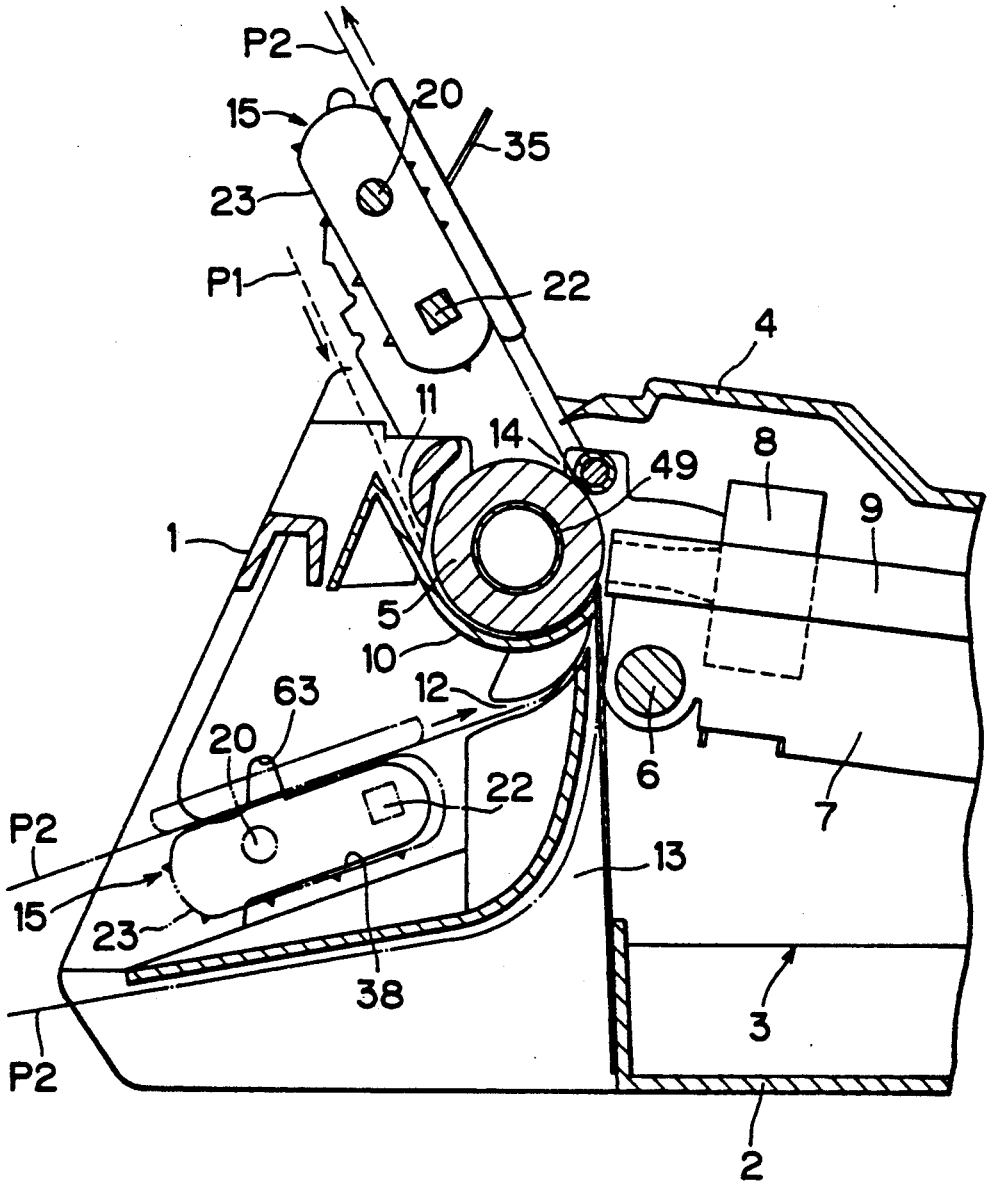
FIG. 1 is a fragmentary side elevational view, partly in cross-section, showing a part of a printer according to one embodiment of the present invention.

As best shown in FIG. 1, a printer has a frame 1 which is composed of a casing 1 made from a synthetic resin and opened at its upper side, a chassis 3 made of steel and composed of left and right side plates 3*a* and 3*b* (FIG. 2) disposed in the casing 1, and a cover member 4 made from a synthetic resin and mounted on the casing 2. The cover 4 is provided with an upper printing sheet supply opening 11.

A platen 5 is rotatably supported between the left and right side plates 3*a* and 3*b*. A guide rod 6 extends, as a guide member, between the left and right side plates 3*a* and 3*b* in parallel spaced relation to the platen 5. A carriage 7 is reciprocably movably mounted on the guide rod 6 and carries on its upper portion a printing head 8 for performing a printing against a cut printing sheet P1 or continuous sheet P2 on the platen 5. An ink ribbon cassette 9 is detachably mounted on the printing head 8.

A printing sheet guide 10 is formed at a portion of the casing 2 and adjacent to a lower outer peripheral surface of the platen 5. The cut printing sheet Pl is supplied from the upper printing sheet supply opening 11, and is guided along the printing sheet guide 10 and fed around the outer peripheral surface of the platen 5.

A rear printing sheet supply opening 12 and a lower printing sheet supply opening 13 are formed at a rear portion and a lower portion, respectively, of the casing 2. Therefore, the continuous printing sheet P2 can be supplied from these printing sheet supply openings 12, 13 toward the outer peripheral surface of the platen 5. A printing sheet discharge opening 14 is provided at an upper portion of the cover member 4 for discharging the cut printing sheet Pl or the continuous printing sheet P2 after the printing sheet Pl or P2 is printed on the platen 5 by means of the printing head 8.

The tractor unit 15 serving as a printing sheet feeding device is detachably mounted on the left and right side plates 3*a*, 3*b*. The tractor unit 15 can be selectively disposed in one of first and second positions. In the first position, the tractor unit, as indicated by a solid lines in FIG. 1, confronts the printing sheet discharge opening 14 on a downstream side of the platen 5 as viewed from the direction of feed of the printing sheet P1, P2. In the second position, the tractor unit 15, as indicated by a two-dot chain lines shown in FIG. 1, confronts the rear printing sheet supply opening 12 on the upstream side of the platen 5 as viewed from the printing sheet feed direction.

Figure 2:
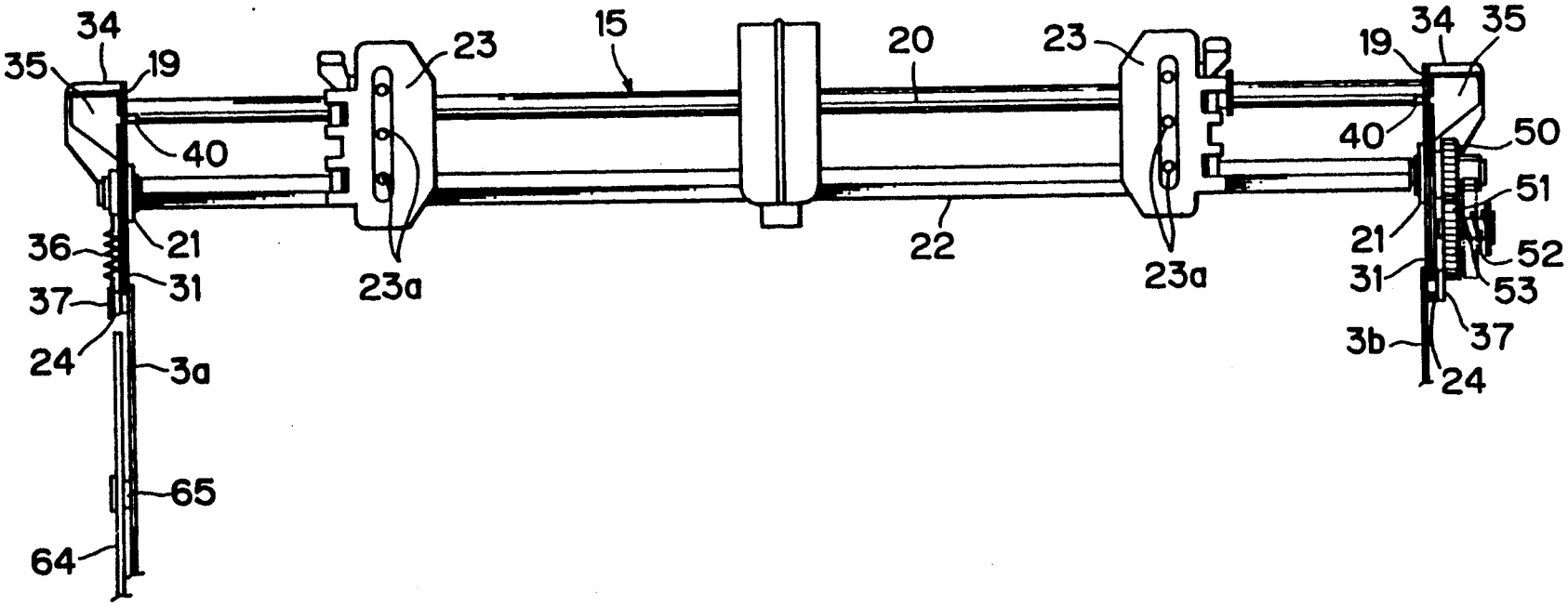
FIG. 2 is a front elevational view showing a tractor unit of the printer.
Figure 6:
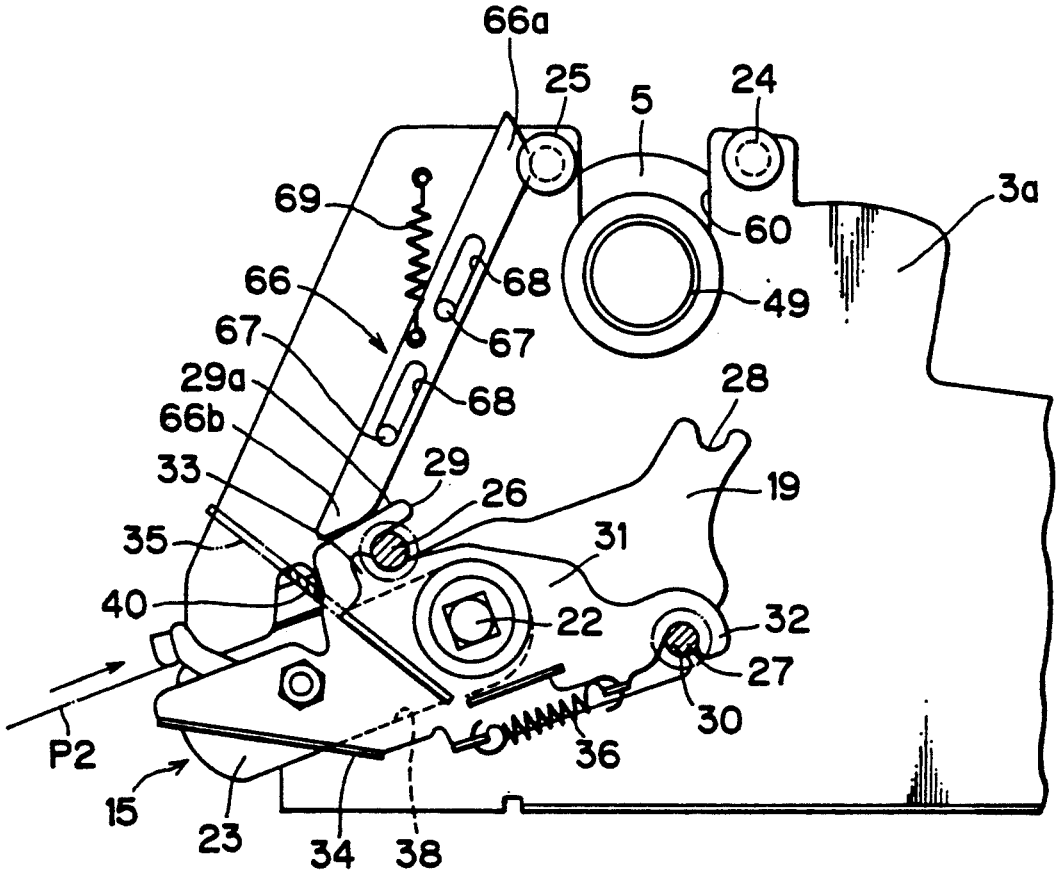
FIG. 6 is a left side view showing the chassis, and showing the manner in which the tractor unit is attached to an upstream side mounting portion as viewed from the printing sheet feed direction.

As shown in FIG. 2, the tractor unit 15 includes left and right support plates 19 each having an upper edge 39 (FIG. 6). The tractor unit 15 also includes a support bar 20 extending between the left and right support plates 19, a rotary shaft 22 extending parallel to the support bar 20 and rotatably supported by the left and right support plates 19 via a pair of bearings 21, and left and right pin tractors 23 mounted astride the support bar 20 and the rotary shaft 22 and movable along the support bar 20 and the rotary shaft 22. The left and right pin tractors 23, 23 have pins 23*a* engageable with pin peed holes formed in and along left and right edge portions of the continuous printing sheet P2. Therefore, the continuous printing sheet P2 can be transferred when the rotary shaft 22 is driven, with the pins 23*a* being engaged with pin feed holes.

With this arrangement, when the tractor unit 15 is disposed on the downstream side of the platen 5 as shown by the solid line in FIG. 1, the continuous printing sheet P2 is supplied from a bottom surface side of the casing 2 into the lower printing sheet supply opening 13. The continuous printing sheet then passes through a printing position on the platen 5 and then is discharged from the printing sheet discharge opening 14 by the tractor unit 15. Thus, the tractor unit 15 is adapted to pull the printing sheet.

On the other hand, when the tractor unit 15 is disposed on the upstream side of the platen 5 as shown by the two dotted chain line in FIG. 1, the tractor unit 15 is adapted for pushing the printing sheet. That is, the continuous printing sheet P2 is fed from the rear printing sheet supply opening 12 to the under side of the platen 5. Then, the printing sheet P2 passes through the printing position, and thereafter is discharged from the printing sheet discharge opening 14.

The structure of a portion for mounting the tractor unit 15 on the chassis 3 will be described below with reference to FIGS. 3 and 6. A platen shaft 49 carrying thereon the platen 5 is detachably fitted in upwardly open cutout recesses 60 formed at respective upper end portions of the left and right side plates 3*a*, 3*b* of the chassis 3. A downstream side mounting portion 61 includes a pair of upper lock pins 24 and 25 projecting laterally outwardly from an outside surface of each of the left and right side plates 3*a*, 3*b* and disposed frontward and rearward, respectively, of a corresponding one of the recesses 60.

Furthermore, an upstream side mounting portion 62 is composed of an inclined guide groove 38 disposed below the platen 5 and extending forwardly and upwardly from a rear end edge of each of the left and right side plates 3*a*, 3*b*, and a pair of lower lock pins 26 and 27 disposed adjacent to the guide groove 38 and projecting laterally outwardly from the outside surface of a corresponding one of the side plates 3*a*, 3*b*. A pair of cutout recesses respectively formed at upper edges of the guide grooves 38. The cutout recesses 63 extend upwardly from rear portions of the guide grooves 38 (see FIG. 3 and 6). Each of the lock pins 24, 25, 26 and 27 has at its front end an enlarged head tapering toward a small-diameter body portion of the lock pin (see FIGS. 4, 5 and 6).

The tractor unit 15 includes an attaching mechanism which is detachable with respect to each of the foregoing mounting portions, as described below. Three engagement recesses 28, 29 and 30 are formed in a front end portion, an upper end portion and lower end portion of each of the left and right support plates 19 of the tractor unit 15. The engagement recesses 28 and 30 are engageable with the upper lock pins 24 and 25 of the downstream side mounting portion 61, while the engagement recesses 29 and 30 are engageable with the lower lock pins 26 and 27 of the upstream side mounting portion 62.

Left and right locking levers 31 are provided on respective outer surfaces of the left and right support plates 19, 19. These locking levers 31 are rotatably mounted on the corresponding bearings 21 of the rotary shaft 22. Each of the locking levers 31 has one end portion provided with a hook portion 32 releasably engageable with the lock pin 25 or the lock pin 27. The locking lever 31 has another end portion provided with a hook portion 33 releasably engageable with the lock pin 26 and provided with an actuating portion 35 disposed in confrontation with a finger rest 34 provided on a corresponding one of the left and right support plates 19. Inwardly projecting locking lugs 40 are formed on the respective actuating portions 35 of the left and right locking levers 31.

A spring 36 is connected between each of the locking levers 31 and the corresponding support plate 19. When the tractor unit 15 is mounted on the upstream side mounting portion 62 (FIG. 6), the locking lever 31 is urged by the force of the spring 36 to turn in such a direction as to keep the hook portions 32 and 33 in interlocking engagement with the lock pins 27 and 26, respectively, against accidental detachment. On the other hand, when the tractor unit 15 is mounted on the downstream side mounting portion 61 (FIG. 3), the locking lever 31 is urged by the force of the spring 36 to turn in such a direction as to keep the hook portion 32 in interlocking engagement with the lock pin 25 against accidental detachment.

In order to hold the tractor unit 15 at the upstream side mounting portion 62 in a predetermined forwardly tilted posture, when the bearings 21 on the left and right support plates 19 are being guided onto the bottom side of the guide grooves 38, the upper edges 39 (FIG.6) of the left and right support plates 19 slide on and along the bottom surfaces of the lower lock pins 26. Further, when the pair of inwardly projecting locking lugs 40 formed on the respective actuating portions 35 of the left and right locking levers 31 is brought into engagement with the pair of cutout recesses 63 formed at the upper edges of the guide grooves 38, the hook portions 32, 33 are held in interlocking engagement with the lock pins 27, 26.

Next, a drive mechanism 43 for driving the platen 5 and the tractor unit 15 will be described below with reference to FIGS. 2, 5 and 7. The drive mechanism 43 is disposed on the outer surface of the right side plate 3*b* of the chassis 3. The driving mechanism 43 includes a motor 44 and a gear train composed of a plurality of gears 45, 46, 47. A platen gear 48 is fixedly coupled to a right end portion of the platen shaft 49, and are meshedly engageable with the gear 47. Therefore, upon rotation of the motor 44, the platen 5 is rotated via the gears 45, 46 and 47 in a predetermined direction (a direction indicated by an arrow shown in FIG. 5) to feed the printing sheet P1 or P2.

A drive gear 50 is fixedly coupled to the right end portion of the rotary shaft 22 projecting from the outside surface of the right support plate 19 of the tractor unit 15. A connecting gear 51 releasably engageable with the drive gear 50 is rotatably supported on a support shaft 52 projecting from the outside surface of the right support plate 19. The connecting gear 51 is movable in the axial direction of the support shaft 52 and is normally urged by a spring 53 in such a direction as to provide the meshing engagement with the drive gear 50.

Figure 5:
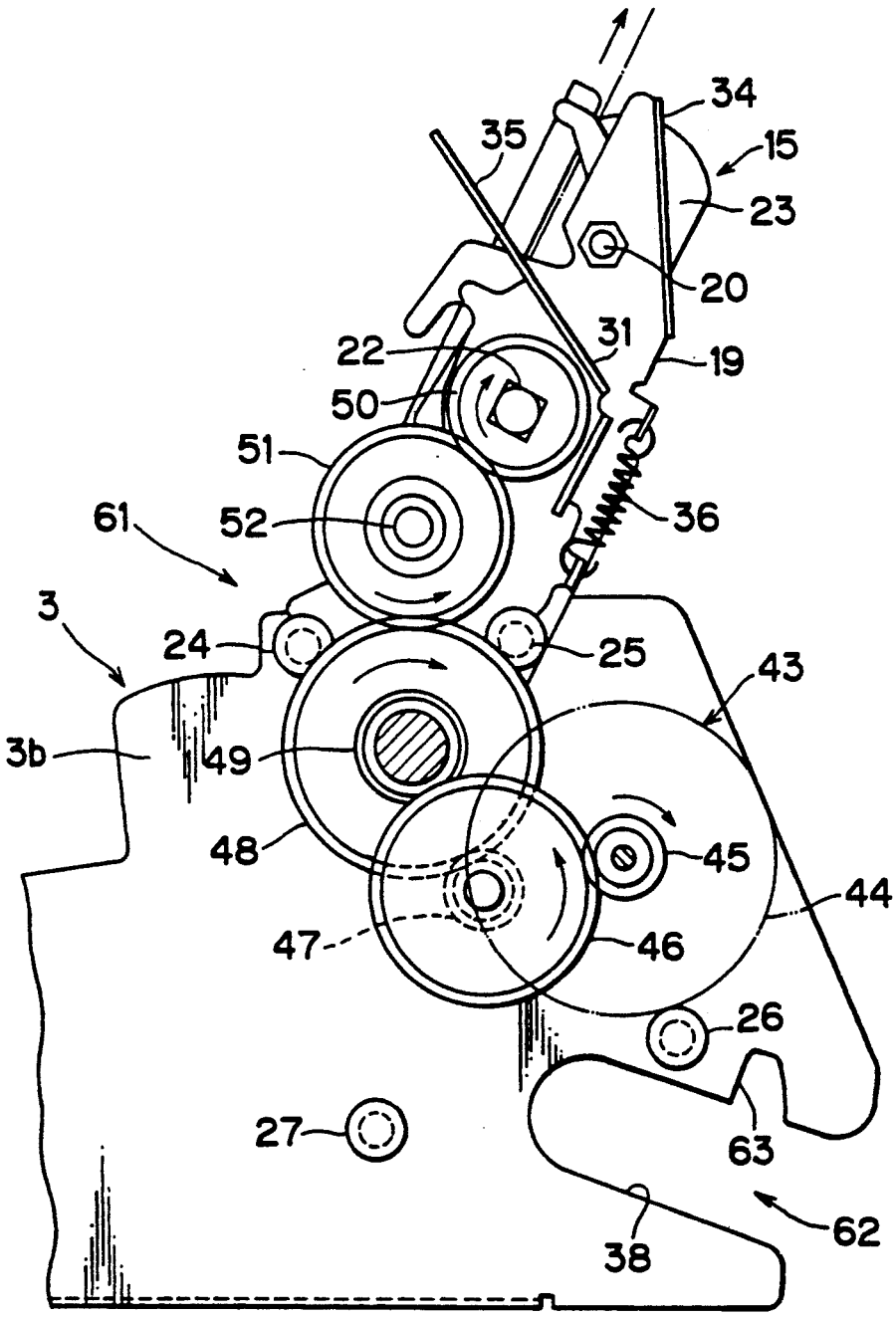
FIG. 5 is a right side view showing the chassis, illustrative of the manner in which a power is transmitted to the tractor unit attached to the downstream mounting portion as viewed from the printing sheet feed direction.

As shown in FIG. 5, when the tractor unit 15 is attached to the downstream side mounting portion 61, the connecting gear 51 is brought into meshing engagement with the platen gear 48. In response to rotation of the motor 44, the rotation of the motor 44 is transmitted via the gear train 45, 46, 47, 48, 51 and 50 to the rotary shaft 22, which in turn rotatably drives the pin tractors 23.

Figure 7:
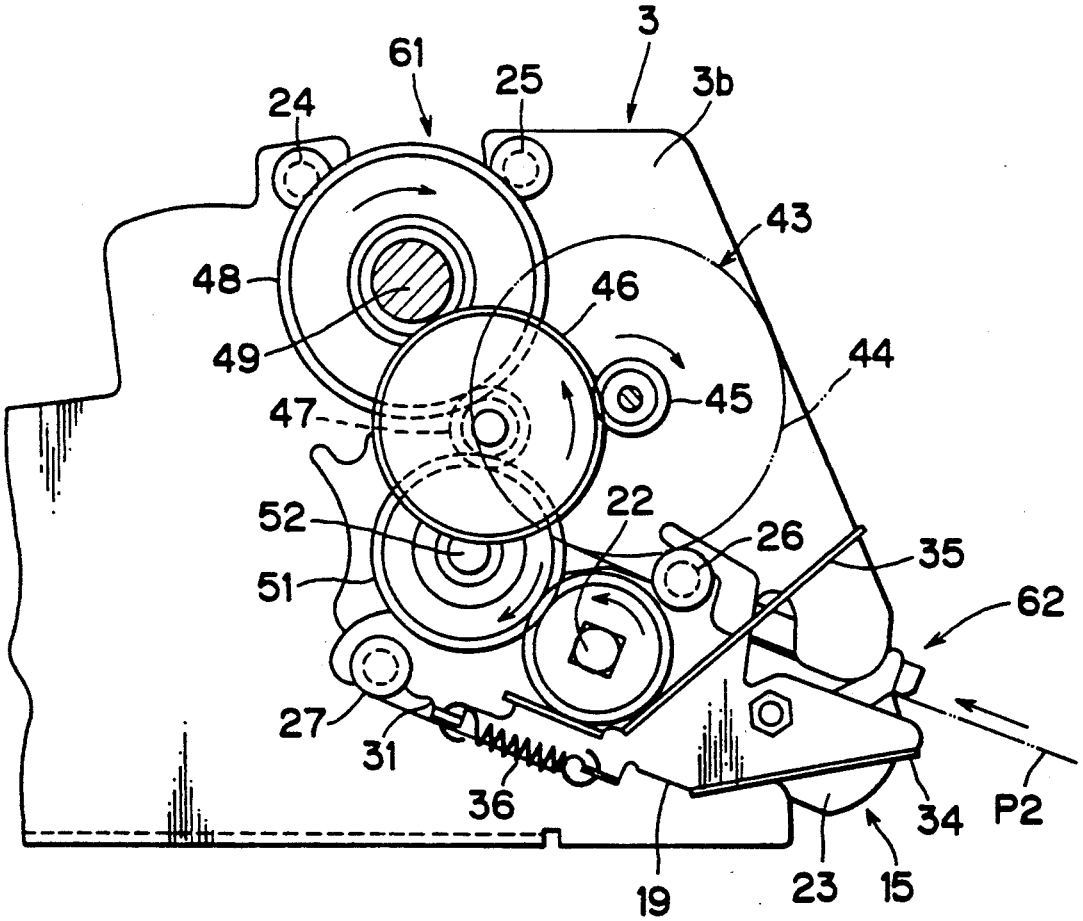
FIG. 7 is a right side view showing the chassis, illustrative of the manner in which a power is transmitted to the tractor unit attached to the upstream side mounting portion as viewed from the printing sheet feed direction.

On the other hand, when the tractor unit 15 is attached to the upstream side mounting portion 62 as shown in FIG. 7, the connecting gear 51 is brought into meshing engagement with the gear 47 so that rotation of the motor 44 is transmitted via the gears 45, 46, 47, 51 and 50 to the rotary shaft 22, which in turn rotatably drives the pin tractors 23.

Figure 3:
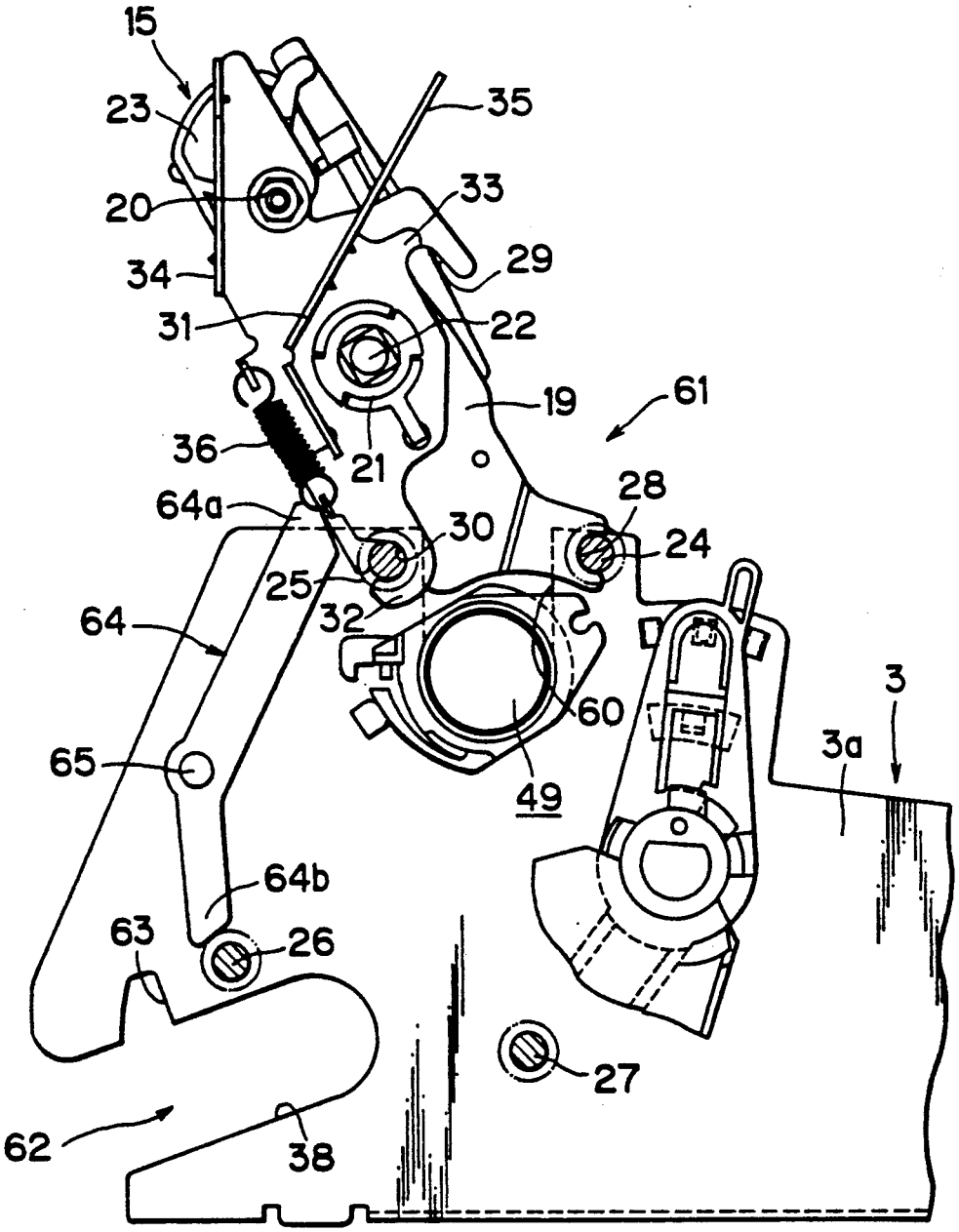
FIG. 3 is a left side view showing a chassis, and showing the manner in which the tractor unit is attached to a downstream side mounting portion as viewed from the direction of feed of a printing sheet.
Figure 4:
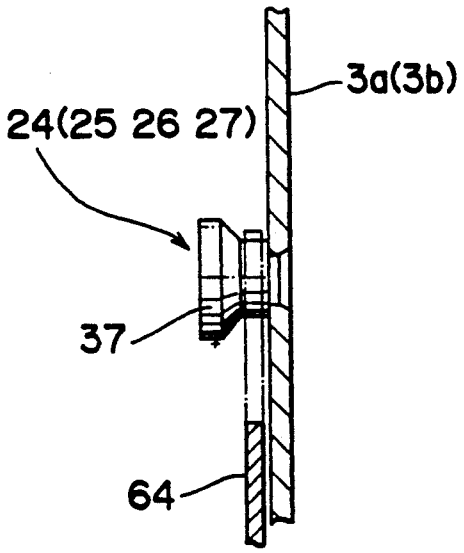
FIG. 4 is an enlarged cross-sectional view showing a portion including a lock pin.

FIGS. 3 and 6 show a rocker member 64 according to the first embodiment of this invention. While the above-mentioned tractor unit 15 has already been set on one of the upstream and downstream side mounting portions 62 and 61 of the chassis, the rocker member 64 serves as means for preventing a similar tractor unit 15 from being erroneously attached to the remaining one of the mounting portion 61 or 62.

In this embodiment, the rocker member 64 is in the form of an elongated flat plate. The rocker member 64 has an intermediate portion pivotally supported to the left side plate 3*a* or the right side plate 3*b* of the chassis 3 by a pivot pin 65 projecting from the side plate 3*a* or 3*b*. The rocker member 64 has an upper end portion 64*a* extending in substantial contact with a small diameter portion of one of the locking pins 25 (FIG. 6) of the downstream side mounting portion 61. The lower end portion 64*b* of the rocker member 64 extends in substantial contact with a small diameter portion of one of the lock pins 26 (FIG. 3) of the upstream side mounting portion 62. The position of the pivot pin 65 is set such that the rocker member 64 normally turns by its own weight in a direction to move the upper end portion 64*a* of the rocker member 64 toward the upper lock pin 25. In this connection, an arm length from the pivot center to the upper end portion 64*a* is greater than that from the pivot center to the lower end portion 64*b* in the illustrated embodiment.

With this construction, when the tractor unit 15 is to be attached to the downstream side mounting portion 61, as shown in FIG. 3, the tractor unit 15 is moved so that the hook portions 28 provided at the forward ends of the left and right support plates 19, 19 are brought into engagement with the lock pins 24. While keeping this engagement, the tractor unit 15 is turned in one direction about the lock pins 24 (in a counterclockwise direction in FIG. 3). Subsequently, the actuating portions 35 is gripped by the user's fingers, so that the hook portions 32 of the locking levers 31 moves from a position spaced from the lock pins 25 into a position engageable with the lock pins 22. During the pivotal movement of the tractor unit 15, one side edge of the support plate 19 urges the upper end portion 64*a* of the rocker member 64 to move away from the lock pin 25, thereby turning the rocker member 64 in one direction (counterclockwise direction in FIG. 3) until the lower end portion 64*b* of the rocker member 64 is brought into contact with the small diameter portion of the lock pin 26 of the upstream side mounting portion 62.

In this condition, if another tractor unit 15 is erroneously moved toward the upstream side mounting portion 62, the engagement recess 29 of the support plate 19 of the other tractor unit is no longer possible to engage the lower lock pin 26 of the upstream side mounting portion 62 because of the mechanical interference with the rocker member 64. Thus, the movement of the another tractor unit 15 into the upstream side mounting portion 62 is blocked by the rocker member 64.

Likewise, if the tractor unit 15 is mounted on the upstream side mounting portion 62, it becomes impossible to mount another tractor unit 15 into the downstream side mounting portion 61. More specifically, while the upper end portion 64*a* of the rocker member 64 is disposed close to the lock pin 25 of the downstream side mounting portion 61, as shown in FIG. 6 because of the weight balance thereof, the tractor unit 15 can readily be moved into the upstream side mounting portion 62. In this condition, an outside edge 29*a* of a pawl portion which defines the engagement recess 29 engaged with the lock pin 26 is in surface engagement with the lower end surface of the lower end portion 64*b*. Therefore, this engagement prevents rotation of the rocker member 64, so that the upper end portion 64*a* of the rocker member 64 is no longer possible to move out of engagement with the upper lock pin 25 of the downstream side mounting portion 61. Thus, inserting movement of the another tractor unit 15 toward the downstream side mounting portion 61 is blocked by the rocker member 64.

As a modification, the rocker member 64 may be urged by a spring (not shown) in a direction to move its upper end portion 64*a* toward the lock pin 25 instead of the natural access of the upper end portion 64*a* to the lock pin 25 because of the own weight of the rocker member 64.

Figure 8:
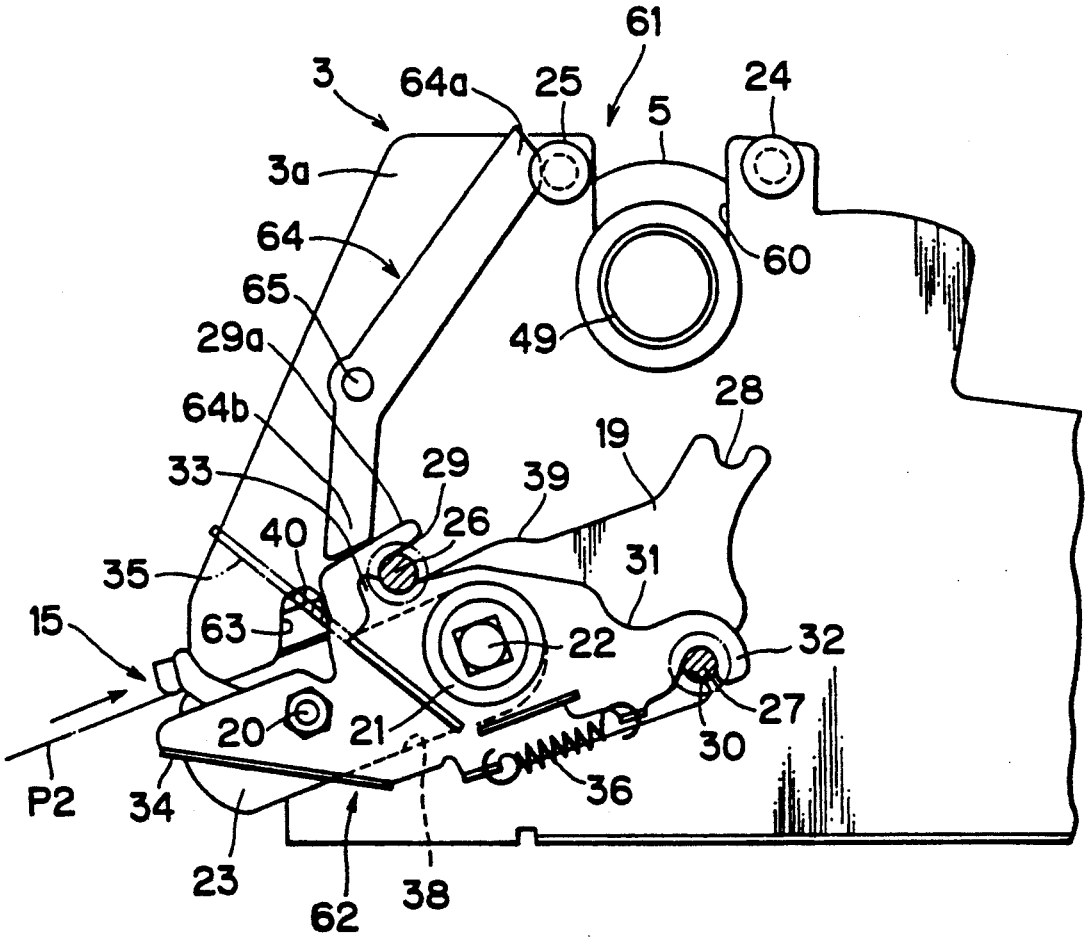
FIG. 8 is a left side view showing a chassis, according to another embodiment of the present invention.

FIG. 8 shows an essential portion according to a second embodiment of this invention. In the second embodiment, two guide pins 67, 67 laterally project from the outer surface of the side plate 3*a* or 3*b* of the chassis 3. Further, an elongated linear blocking member 66 having a plate like shape is provided. the blocking member 66 is formed with two longitudinally spaced guide slots 68, 68 extending in a longitudinal direction thereof. The guide slots 68, 68 are slidably engageable with the corresponding pins 67, 67. A spring 69 is provided between the blocking member 66 and the one of the side plates 3*a* (3*b*) for urging the blocking member 66 so that an upper end portion 66*a* of the blocking member 66 can be moved toward the small diameter portion of the lock pin 25.

In this embodiment, the outside edge of the pawl portion 29*a* which defines the engagement recess 29 engaged with the lower lock pin 26 prevents downward movement of the lower end portion 66*b* of the blocking member 66. Thus, the upper end portion 66*a* of the blocking member 66 is no longer separable from the upper lock pin 25. It is therefore possible to prevent another tractor unit 15 from moving toward the upper lock pin 25. Similarly, if the tractor unit 15 is moved toward the downstream side mounting portion 61, the support plate 19 of the tractor unit 15 forces the upper end portion 66*a* of the blocking member 66 downwardly against the biasing force of the spring 69 so as to hold the blocking member 66 in a condition in which the lower end portion 66*b* of the blocking member 66 is located close to the lower lock pin 26. Thus, another tractor unit 15 is no longer possible to move into the upstream side mounting portion 62.

Regarding modification, in place of the mechanical arrangement described above, an electric control system may be used. That is, two limit switches are provided at the downstream side mounting portion 61 and the upstream side mounting portion 62 for detecting two tractor units 15 moving into these mounting portions 61 and 62. With this arrangement, a control is made such that the motor 44 is energizable only when one of these limit switches is rendered ON whereas the other limit switch is rendered Off.

As described above, according to the present invention, the rocker member or the blocking member is movably disposed on the side surface of the chassis. When one tractor unit is to be set on an upstream side mounting portion or a downstream side mounting portion of the 0chassis, this tractor unit, as it is advanced toward the selected mounting portion, engages one end portion of the rocker member and then displaces the rocker member. In proportion to the amount of displacement of the rocker member, the other end portion of the rocker member prevents another tractor unit from moving into the other mounting portion. Thus, in the case where one tractor unit is already attached to one mounting portion, it is no longer possible to attach another tractor unit to the other mounting portion. Since the rocker member is automatically moved to a position to prevent the other tractor unit from attaching to the other mounting portion in response to the attachment of the tractor unit on one mounting portion, it is possible to perfectly prevent an erroneous use of the printer by the operator.

While the invention has been described in detail and with reference to specific embodiments thereof, it would be apparent to those skilled in the art that various changes and modifications may be made without departing from the spirit and scope of the invention.

What is claimed is:

1. A printer for printing an image on a printing sheet comprising;

a chassis;

a platen rotatably supported by the chassis for supporting and feeding the printing sheet in a sheet feeding direction, the platen defining a printing section;

a tractor unit for feeding the printing sheet to the printing section, the chassis providing a first tractor unit attaching portion positioned downstream of the platen with respect to the sheet feeding direction and a second tractor unit attaching portion positioned upstream of the platen, the tractor unit being selectively mounted on one of the first and second tractor unit attaching portions; and means for preventing another identical tractor unit of another printer from being attached onto one of the first and second tractor unit attaching portions if remaining one of the second and first tractor unit attaching portion has already accommodated therein the tractor unit.

2. The printer as claimed in claim 1, wherein the preventing means comprises a blocking plate member movably supported on the chassis, the blocking member having a first position to provide mechanical interference against the another tractor unit when the another tractor unit is to be attached to the second tractor unit attaching portion and a second position providing a mechanical interference against the another tractor unit when the another tractor unit is to be attached to the first tractor unit attaching portion.

3. The printer as claimed in claim 2, wherein the blocking plate member has first end abuttable on the tractor unit attached to the first tractor unit attaching portion, the blocking plate member being movable by the abutment between the first end and the tractor unit to provide the first position of the blocking plate member.

4. The printer as claimed in claim 3, wherein the blocking plate member has a second end surface engageable with the tractor unit attached to the second tractor unit attaching portion, the engagement between the second end and the tractor unit maintaining the second position of the blocking plate member.

5. The printer as claimed in claim 4, wherein the blocking plate member comprises a rocker member pivotally supported to the chassis, the rocker member having an intermediate pivot portion, a major arm portion extending from the intermediate pivot portion toward the first tractor unit attaching portion, and a minor arm portion extending from the intermediate pivot portion toward the second tractor unit attaching portion, a free end of the major arm portion defining the first end and a free end of the minor arm portion defining the second end, the rocker member normally providing a second pivot position corresponding to the first position because of a weight imbalance between the major and minor arm portions.

6. The printer as claimed in claim 5, wherein the tractor unit is formed with first, second and third recesses, and wherein the chassis is provided with a first pair of pins at the first tractor unit attaching portion to engage the first and second recesses for fixing a position of the tractor unit at the first tractor unit attaching portion and a second pair of pins at the second tractor unit attaching portion to engage the second and third recesses for fixing a position of the tractor unit at the second tractor unit attaching portion.

7. The printer as claimed in claim 6, wherein the free end of the major arm portion being abuttable on one of the first pair of pins when the rocker member has the second pivot position for preventing the second recess of the another tractor unit from being engaged with one of the pins of the first pair of pins, and wherein the free end of the minor arm portion being abuttable on one of the second pair of pins when the rocker member has the first pivot position for preventing the third recess from being engaged with one of the pins of the second pair of pins.

8. The printer as claimed in claim 4, wherein the blocking plate member comprises a linear plate member, and wherein the preventing means further comprises biasing means connected between the chassis and the linear plate member for normally urging the linear plate member toward the second position.

9. The printer as claimed in claim 8, wherein the chassis is provided with a pair of pins, and wherein the linear plate member is formed with a pair of slots extending in a longitudinal direction thereof, the slots being slidably engageable with the pins for selectively providing the first and the second position.

10. The printer as claimed in claim 9, wherein the tractor unit is formed with first, second and third recesses, and wherein the chassis is provided with a first pair of pins at the first tractor unit attaching portion to engage the first and second recesses for fixing a position of the tractor unit at the first tractor unit attaching portion and a second pair of pins at the second tractor unit attaching portion to engage the second and third recesses for fixing a position of the tractor unit at the second tractor unit attaching portion.

11. The printer as claimed in claim 10, wherein a first end of the linear plate member being abuttable on one of the first pair of pins when the linear plate member has the second position for preventing the second recess of the another tractor unit from being engaged with one of the pins of the first pair of pins, and wherein a second end of the linear plate member being abuttable on one of the second pair of pins when the linear plate member has the first position for preventing the third recess from being engaged with one of the pins of the second pair of pins.

* * * * *